United States Patent [19]

Janda

[11] 4,334,134

[45] Jun. 8, 1982

[54] IDENTIFICATION CAP ACTUATOR ASSEMBLY

[75] Inventor: George M. Janda, Westchester, Ill.

[73] Assignee: GTE Automatic Electric Labs Inc., Northlake, Ill.

[21] Appl. No.: 206,493

[22] Filed: Nov. 13, 1980

[51] Int. Cl.[3] ..... H01H 9/06

[52] U.S. Cl. ..... 200/314; 200/159 B; 200/292; 200/333; 200/340

[58] Field of Search ..... 200/310, 311, 314, 317, 200/340, 292, 159 B, 159 A, 159 R, 5 A, 293, 303, 333, 309

[56] References Cited

U.S. PATENT DOCUMENTS

| | | | |
|---|---|---|---|
| 3,749,872 | 7/1973 | Foster | 200/292 |
| 3,773,998 | 11/1973 | Seeger et al. | 200/159 B |
| 3,917,917 | 11/1975 | Murata | 200/313 |
| 3,974,352 | 8/1976 | Pite et al. | 200/293 |
| 4,002,873 | 1/1977 | Lewandowski | 200/159 R |
| 4,052,579 | 10/1977 | Arthur | 200/159 A |
| 4,052,580 | 10/1977 | Stanish | 200/303 |
| 4,057,520 | 11/1977 | Schwartz | 200/292 |

FOREIGN PATENT DOCUMENTS

| | | | |
|---|---|---|---|
| 1218590 | 6/1966 | Fed. Rep. of Germany | 200/314 |

*Primary Examiner*—John W. Shepperd

*Attorney, Agent, or Firm*—Robert J. Black; Anthony Miologos

[57] ABSTRACT

A momentary contact actuator and identification cap assembly disposed to be used with a single switch of a laminated flat-panel keyboard. The assembly consists of a clear cap component which snaps over a flat-panel switch, an identification insert, and a tension bar including spring arms situated within the interior of the clear cap. The spring arms hold the assembly suspended over the associated flat-panel switch. Manual pressure applied to the clear cap deflects the assembly operating the flat-panel switch.

5 Claims, 2 Drawing Figures

IDENTIFICATION CAP ACTUATOR ASSEMBLY

BACKGROUND OF THE INVENTION (1) Field of the Invention

This invention relates generally to laminated flat-panel switches and more particularly to an identification cap actuator assembly for use with laminated flat-panel switches.

(2) Description of the Prior Art

Flat-panel switches and keyboards constructed of laminated plastic and conductive substrates are currently utilized in electronic calculators and in other electronic apparatus for digital control and data entry. This type of panel switch provides a flat key assembly in which conventional electromechanical pushbuttons are replaced by a relatively thin, flexible member having one side in a facing relationship with the switch elements so that the deflection of the member in response to force manually exerted on the other side of the member actuates a respective switch element. This type of switch technology offers the utmost in simplicity, low cost, space saving design features and low tooling investment. These factors are significant in comparison to comparable assemblies consisting of discrete electromechanical switches.

Currently, flat-panel switches are limited in certain applications because the graphic designation (identification/labels) of the particular switch are an integral part of the laminated assembly and therefore are limited to only fixed or permanent switch designations. Consequently, the use of laminated flat-panel switch assemblies or keyboards are not suitable for product applications where switches are identified or assigned functions after manufacturer of the keyboard or panel. Such as in key telephones or PABX console applications.

Therefore, it becomes an object of the present invention to design an identification cap actuator assembly providing the means of assigning designations to laminated flat-panel switch assemblies after the manufacture of the panel.

SUMMARY OF THE INVENTION

In accomplishing the object of the present invention there is provided an identification cap actuator consisting of a three part assembly which snaps onto a laminated flat-panel keyboard. The assembly is comprised of a cap component, an identification strip and a tension bar.

The clear cap component consists of a five sided clear plastic part having a tab extending below the bottom edge of two sides of the cap component. The tabs of the rectangular shaped cap are located on the end walls or short sides of the configuration. Within the clear cap the identification insert and the tension bar components are located. The identification insert is a sheet of paper or plastic on which identification or other designation messages can be printed, typed or handwritten. For switches requiring illumination from either incadescent lamps or LED's, an opening at one end of the identification insert is provided conforming to the configuration of the light source. The identification insert is retained in the cap component by use of the third component of the assembly, the tension bar.

The tension bar located beneath the insert holds the insert against the bottom of the top surface of the clear cap when the cap assembly is mounted over an individual switch of the flat-panel keyboard. The tension bar is a flat metal or plastic panel which has two legs extending from its bottom surface. The legs extend outward from the center of the bar at an angle of less than 45 degrees. The edges of the legs travel across the surface of the switch panel when a downward force is applied to the top surface of the bar. A downwardly extending actuator finger is located between the legs which when assembled locates the finger directly above the associated switch.

The assembly is mounted over the associated switch by inserting the end walls of the clear cap into an associated slot located on either side of the switch. The slots allow the tabs of each end wall to engage the bottom surface of the flat-panel keyboard with the tension bar providing a compression force against the clear cap keeping the cap suspended above the associated switch. A downward force applied to the clear cap deflects the assembly allowing the actuator finger to apply the force to the switch closing the respective switch contacts.

BRIEF DESCRIPTION OF THE DRAWINGS

A better understanding of the invention may be had from the consideration of the following detailed description taken in conjunction with the accompanying drawings in which.

DESCRIPTION OF THE PREFERRED EMBODIMENT

Figure 1:
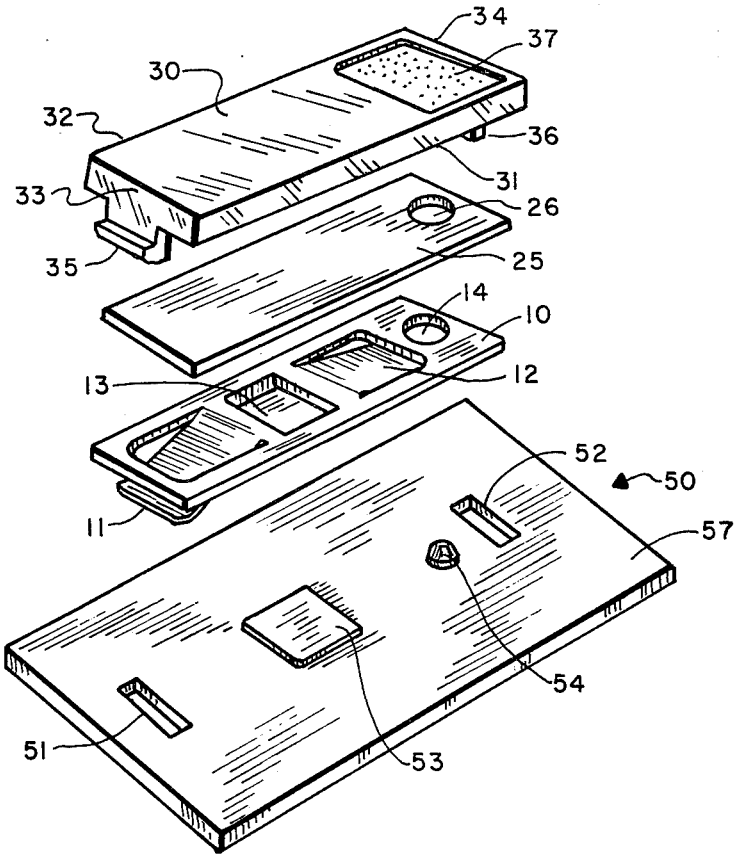
FIG. 1 is an exploded perspective view showing the identification cap actuator assembly in accordance with the present invention.

Turning now to FIG. 1 of the included drawings the identification cap actuator assembly of the present invention is illustrated. The assembly is comprised of a clear cap component 30, an identification strip 25 and a tension bar 10. The assembly is arranged to mount over a single switch of a laminated flat-panel switch assembly 50.

The clear cap component 30 consists of a rectangularly shaped five sided clear plastic part including longitudinal walls 31, 32 and end walls 33, 34. End walls 33 and 34 further include downwardly extending leg portions generally configuring each end wall into a T shape structure. Each leg terminates in a tab member 35, 36.

Within the clear cap component 30 the identification insert 25 and tension bar components 10 are located. The identification insert 25 is a rectangular sheet of paper or plastic on which identifying indicia or any other designation message may be printed, typed or handwritten thereon. The identification insert is retained in the cap component by use of tension bar 10.

The tension bar is located beneath the insert 25 and holds the insert against the bottom of the top surface of the clear cap when the cap assembly is mounted to a flat-panel switch. The tension bar 10 is a flat stamped metal or formed plastic panel which has two legs 11, 12 extending from its bottom surface. These legs extend outward from the center of the bar at an angle of less than 45 degrees. The edges of members 11, 12 travel across surface 57 of the switch panel 50 when a downward force is applied to the top surface of bar 10. A downwardly extending finger 13 is located between legs 11, 12 which when assembled locates finger 13 directly above the associated switch.

Figure 2:
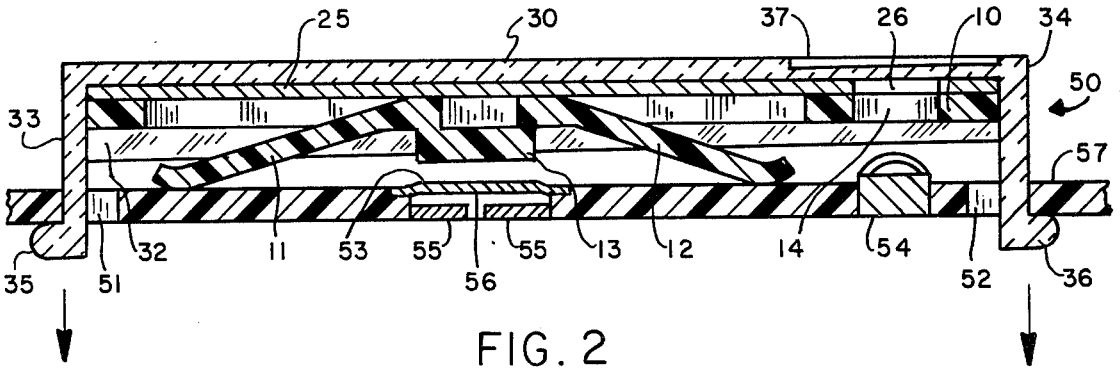
FIG. 2 is a longitudinal sectional view of the identification cap actuator assembly as installed on a laminated flat-panel switch.

Turning now to FIG. 2 the identification cap assembly is shown in section mounted to a typical laminated flat-panel switch. As can be seen laminated switch 53 is comprised of a raised area having internal conductor portions 55 and 56. Each of conductors 55 would be electrically connected to a source of electrical current and would pass current when resilient dome contact elements 56 is urged downward allowing contact 56 to contact conductors 55.

The assembly is mounted over switch 53 by inserting tabs 35, 36 and respective end walls of the clear cap component 30 into associated slots 51, 52. Tabs 35 and 36 engage the bottom surface of the flat-panel keyboard 50 with tension bar legs 11, 12 providing a compression force against the clear cap 30 keeping the cap suspended above switch 53. As can be seen in FIG. 2, finger 13 of tension bar 10 is situated directly above switch 53 and a manual force applied to the top surface of clear cap 30 will deflect the cap downward with the respective end wall legs extending through slots 51 and 52 until finger 13 contacts switch 53 urging contact element 56 to contact conductors 55. With manual pressure removed the clear cap component 30 is restored to its original position by action of the spring bias of tension bar legs 11, 12. For switches requiring illumination from either incandescent lamps or LED's an opening 14 on tension bar 10 and an opening 26 on the identification insert is provided comforming to the configuration of the light source. Such as light source 54 shown on FIGS. 1 and 2. The clear cap component further includes a recess area 37 on the surface thereof as a defuser panel for light source 54. The identification cap assembly may be removed by applying an inward pressure to end walls 33, 34 allowing tabs 35, 36 to be lifted out of respective slots 51, 52.

The present invention has been described with reference to a speciffic embodiment thereof, for the purpose of illustrating the manner in which the invention may be used to advantage. It would be appreciated by those skilled in the art that the invention is not limited thereto. Accordingly any and all modifications, variations, or equivalent arrangements which may occur to those skilled in the art should be considered to be within the scope of the invention.

What is claimed is:

1. An identification cap actuator adapted to cooperate with circuit closing a means, said circuit closing means including a circuit board having conductors thereon, a resilient dome contact element in spaced apart relationship to said conductors and adapted to make contact with said conductors upon the application of a force thereon, said circuit board further including a pair of slots extending through said circuit board each on an opposite side of said dome contact element, said identification cap actuator comprising:

a clear cap having top and bottom surfaces and at least two walls extending perpendicularly to said top and bottom surfaces, each of said walls including leg portions extending beyond said respective wall and each leg portion inserted into a different one of said circuit board slots;

a tension bar including a horizontally oriented member, a pair of arms each arm extending obliquely from said horizontal member and in opposite directions from each other and a finger located between said arms, said tension bar arranged to install within said clear cap with said arms resting on said circuit board and holding said clear cap in a spaced relation to said circuit board with said finger in juxtaposition to said dome contact element; and an indentification insert including identifying indicia thereon sandwiched between said clear cap bottom surface and said tension bar horizontal member, said indicia visible through said clear cap top surface;

whereby, in response to a manual pressure applied to said clear cap top surface said clear cap legs extend through said respective slots and said tension bar is urged downward allowing said tension bar finger to apply said pressure to said dome contact element allowing said dome contact element to contact said conductors.

2. An identification cap actuator as claimed in claim 1, wherein: said circuit board includes a bottom surface and each of said clear cap legs include tabs, each of said tabs arranged to be inserted into a respective circuit board slot engaging said circuit board bottom surface securing said clear cap to said circuit board.

3. An identification cap actuator as claimed in claim 1, wherein: said clear cap is rectangular in shape and includes left and right side walls and front and back end walls, each of said side and end walls extending perpendicular to said top and bottom surface and each of said end walls include said leg portions.

4. An identification cap actuator as claimed in claim 1, wherein: said circuit board further includes a source of illumination and said tension bar includes an opening situated in direct alignment with said source of illumination rendering said source of illumination visible when said tension bar is installed on said circuit board.

5. An identification cap actuator as claimed in claim 4, wherein: said identification insert includes an opening in alignment with said tension bar opening rendering said source of illumination visible when said identification insert is installed on said tension bar.

* * * * *